United States Patent [19]

Eber et al.

[11] 4,431,388

[45] Feb. 14, 1984

[54] CONTROLLED SUCTION UNLOADING IN A SCROLL COMPRESSOR

[75] Inventors: David H. Eber, La Crosse; Robert E. Utter, Genoa, both of Wis.

[73] Assignee: The Trane Company, La Crosse, Wis.

[21] Appl. No.: 354,989

[22] Filed: Mar. 5, 1982

[51] Int. Cl.[3] ..... F04C 18/02; F04C 29/08; F04B 49/02

[52] U.S. Cl. ..... 418/55; 417/295; 417/302; 417/440; 417/902

[58] Field of Search ..... 418/55; 417/295, 302, 417/440, 902

[56] References Cited

U.S. PATENT DOCUMENTS 4,383,805 5/1983 Teegarden et al. ..... 418/55

FOREIGN PATENT DOCUMENTS 53-141913 11/1978 Japan .
54-28002 2/1979 Japan .

*Primary Examiner*—John J. Vrablik
*Attorney, Agent, or Firm*—Carl M. Lewis; Ronald M. Anderson; Raymond W. Campbell

[57] ABSTRACT

Apparatus for unloading a scroll compressor to modulate its capacity by separately controlling fluid flow into first and second inlets. The first and second inlets are disposed diametrically opposite each other in a fixed scroll plate, and are enclosed by a perimeter wrap which extends from the radially outer end of the fixed spiral shaped wrap element. A compliant sealing member is provided between the inner surface of the perimeter wrap and the outer flank surface of the orbiting scroll wrap to interrupt fluid flow between the two inlets through this area. Valves connected to the first and second inlets selectively control the flow of suction fluid into fluid pockets being formed between the radially outer ends of the orbiting and fixed wrap elements to unload the compressor over an extended range of its rated output capacity.

20 Claims, 8 Drawing Figures

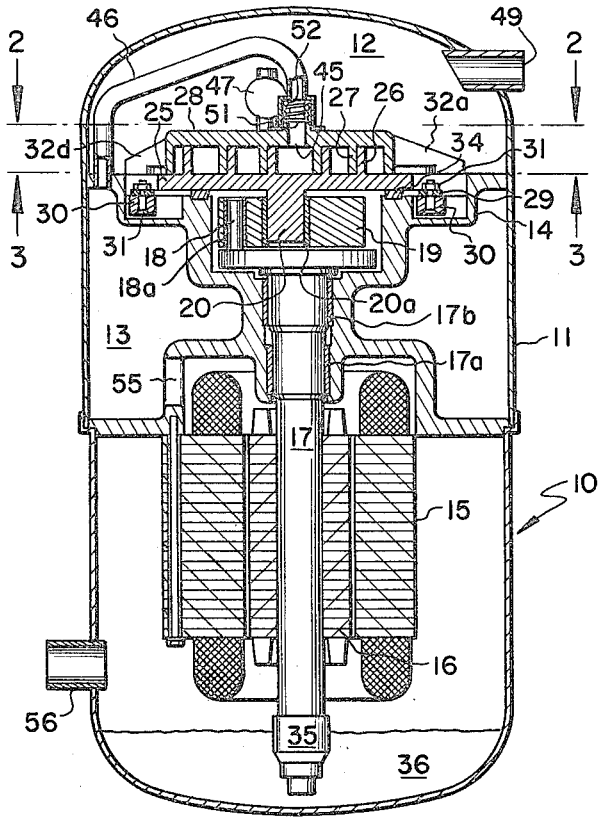
FIG. 1
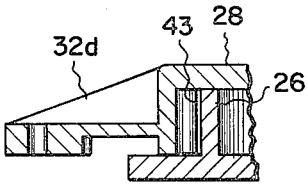
FIG. 4
FIG. 3
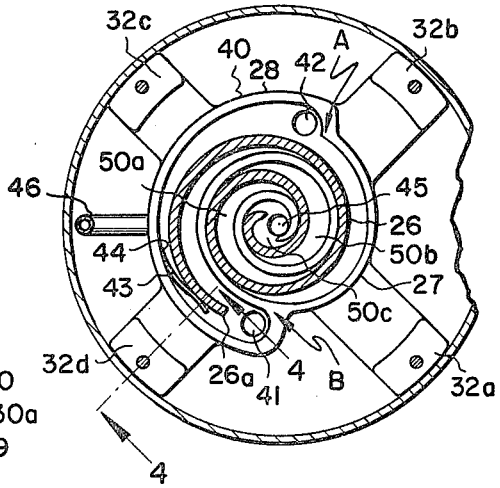
FIG. 2
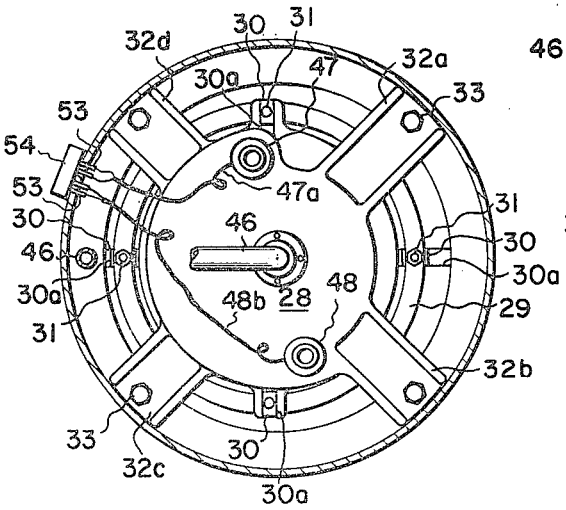

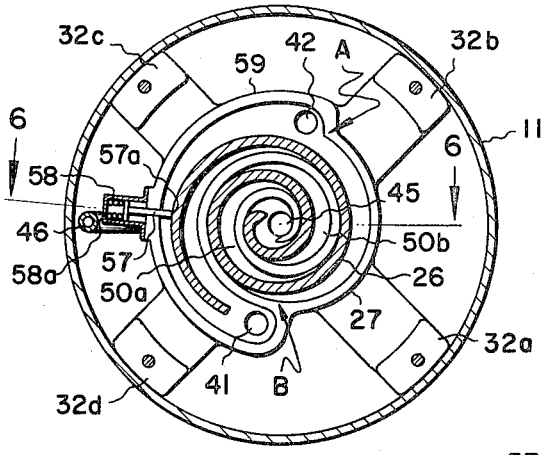
FIG. 5
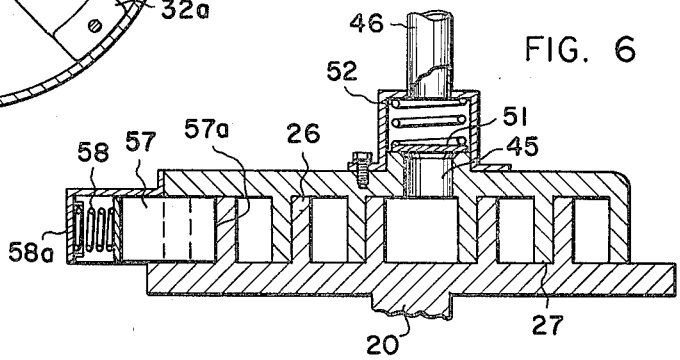
FIG. 6
FIG. 8
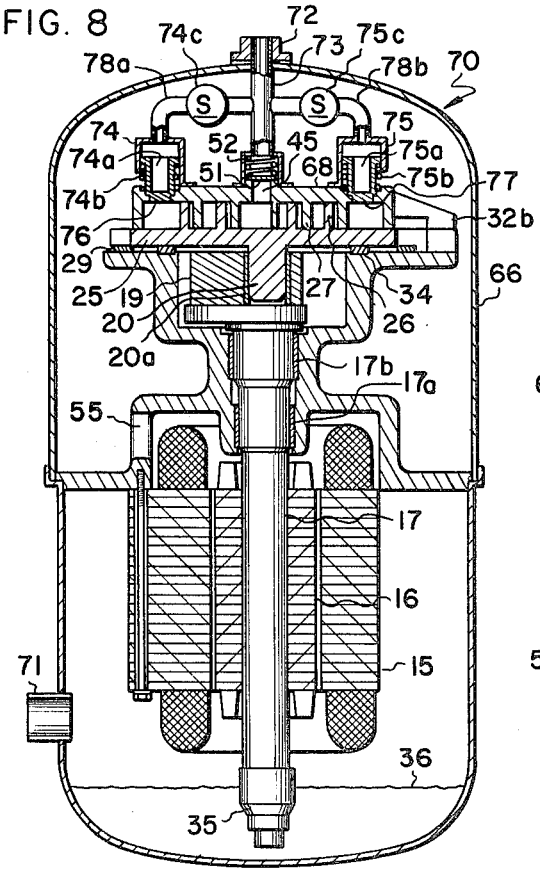
FIG. 7
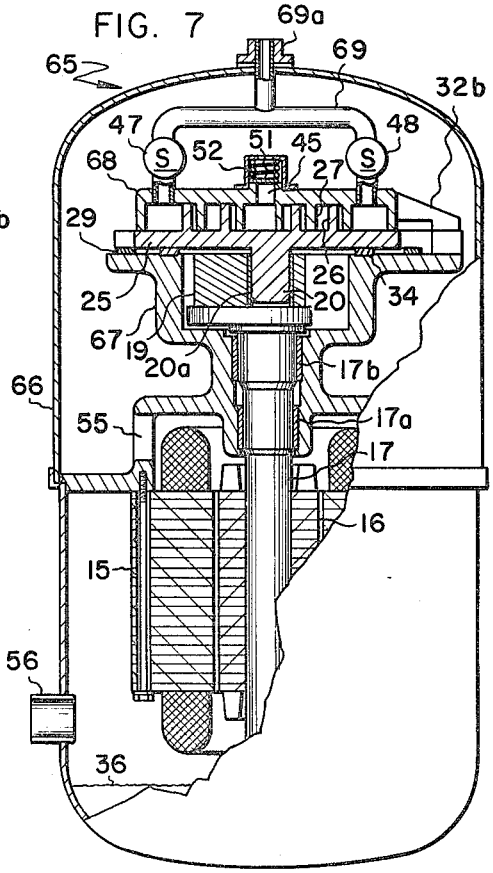

CONTROLLED SUCTION UNLOADING IN A SCROLL COMPRESSOR

DESCRIPTION

1. Technical Field

This invention generally pertains to a positive fluid displacement compressor of the scroll type and specifically, to a scroll compressor with throttled suction unloading for capacity modulation.

2. Background Art

Positive fluid displacement apparatus of the scroll type typically include parallel plates having involute wrap elements attached in intermeshed, fixed angular relationship. The axes of the wrap elements are normally parallel and offset such that their relative orbital motion causes pockets of fluid defined by flank surfaces of the wrap elements and the plates, to move between an inlet and an outlet. When used as a compressor, the pockets of fluid are caused to move inward around the scroll wraps, toward a center discharge port, so that the fluid trapped therein experiences a decrease in volume and an increase in pressure.

As with reciprocating compressors and especially those applied to refrigeration and air conditioning applications, it is desirable to modulate the capacity of a scroll compressor to reduce cycling and save energy. In a refrigeration system, a reduced cooling demand may be met by repetitively starting and stopping the compressor, or by unloading it so that its capacity equals the demand. Since rapidly cycling any compressor on and off is likely to reduce its operating life, it is preferable to modulate the compressor capacity in an energy efficient manner.

In a previous application, Ser. No. 202,967, now U.S. Pat. No. 4,383,805, assigned to the same assignee as the present one, a scroll compressor having delayed suction closing to modulate capacity was disclosed. That application shows valve means for venting to suction the pockets of fluid formed between the intermeshed flank surfaces of the wrap elements at selected intermediate points, as the pockets move around the wraps toward a center discharge port. This method is somewhat analogous to venting the cylinder of a reciprocating compressor to suction during part of the compression stroke.

Two Japanese patent applications, "laid-open" prior to examination, Nos. 53-141913 and 54-28002, each disclose alternative means to change the capacity of a scroll compressor by varying the volume of the pockets between the wrap elements. In application No. 53-141913, the separation between facing plates through which the spiral wraps extend, may be changed by raising or lowering the stationary scroll. In the other application, a section in one of the facing plates is raised or lowered to change the compression ratio.

One of the most efficient ways to modulate the capacity of a multicylinder reciprocating compressor is to close off fluid flow through the suction port to one of its cylinders. This is similar to blocking fluid flow to a fluid pocket being formed at the outer ends of the spiral wrap elements in a scroll compressor, but is easier to implement in a reciprocating compressor. Typically in a scroll compressor, both outer ends of the wrap elements are open to the same suction pressure, drawing fluid from inside an hermetic shell. Therefore, the flow of fluid into the pockets formed at the radially outer end of each of the scroll wraps is not independently controllable. If the flow of suction gas to one or both inlets can be separately controlled, the capacity of the scroll compressor can be modulated over a much broader range, and more efficiently controlled.

It is therefore an object of this invention to provide efficient means for modulating capacity of a scroll compressor by controlling the flow of suction fluid into the compressor.

A further object of this invention is to modulate the capacity of a scroll compressor over a relatively wide range.

A still further object of this invention is to provide means to independently control the flow of suction gas into inlets at the outer end of each spiral wrap element on a scroll compressor.

Yet a further object of this invention is to provide a scroll compressor having an hermetic shell with an interior at discharge pressure, and means for selectively conveying suction gas from a suction port to the inlets of the spiral wrap elements.

These and other objects of the invention will become evident from the description of the preferred embodiments which follow and from the attached drawings.

DISCLOSURE OF THE INVENTION

The scroll compressor of the subject invention comprises two generally parallel plates, the facing surface of each having an involute wrap element attached thereon in fixed angular, intermeshed relationship with the wrap element of the other. These involute wrap elements each define a radially inner and a radially outer flank surface of similar spiral shape about an axis. Contacting flank surfaces of the intermeshed involute wrap elements and the plates define pockets of fluid.

The scroll compressor also includes a drive shaft rotatably driven about a longitudinal axis by a prime mover. The drive shaft is operatively connected to one of the two parallel plates in driving relationship, so that when the shaft is rotating, it causes that plate to orbit relative to the other plate which is fixed.

The fixed plate has a perimeter wrap attached on the same surface as the fixed involute wrap element, and the perimeter wrap extends in a lobular shape that encloses the involute wrap element on the orbiting plate in circumvallate, sealing relationship. Also enclosed by the perimeter wrap are a first and a second fluid inlet. These inlets are disposed in the fixed plate, adjacent its periphery and diametrically opposite each other. They are in fluid communication with one or more of the fluid pockets formed by moving line contacts between the wrap elements.

A compliant sealing member is disposed radially inside the perimeter wrap, between it and the outer flank surface of the orbiting involute wrap element and between the parallel plates, in sealing relationship therewith. This sealing member acts to prevent fluid flow between the first and second fluid inlets. Valve means are also provided for controlling fluid flow to at least one of the first and second fluid inlets, and thus are selectively operative to modulate the capacity of the compressor.

BRIEF DESCRIPTION OF THE DRAWINGS

FIG. 1 is a cutaway view of one of the embodiments of the subject invention wherein a top chamber in an hermetic shell is at suction pressure and a lower chamber is at discharge pressure.

FIG. 2 is a cross-sectional view taken along section line 2—2 of FIG. 1.

FIG. 3 is a cross-sectional view taken along section line 3—3 of FIG. 1.

FIG. 4 is a cross-sectional view taken along section line 4—4 of FIG. 1, and shows an embodiment of the compliant sealing member in greater detail.

FIG. 5 is analogous in view to FIG. 3, but illustrates another embodiment of the compliant sealing member.

FIG. 6 is a cross-sectional view taken along section line 6—6 of FIG. 5.

FIG. 7 illustrates another embodiment of the invention in cutaway aspect, wherein the hermetic shell is at discharge pressure.

FIG. 8 illustrates yet another embodiment of the invention in cutaway aspect, wherein the hermetic shell is at suction pressure.

DESCRIPTION OF THE PREFERRED EMBODIMENTS

Referring to FIG. 1, a scroll compressor including a first embodiment of the subject invention is generally denoted by reference numeral 10. Compressor 10 includes an hermetic shell 11 which acts as a sealed housing for an upper chamber 12 which is at suction pressure and a lower chamber 13 at discharge pressure. Chambers 12 and 13 are defined within hermetic shell 11 by a support frame 14 which is sealed around its perimeter where it contacts the interior of hermetic shell 11 by an "0" ring (not shown), by other suitable gasket means, or by welding. Support frame 14 also serves to axially align the mechanism comprising scroll compressor 10 within hermetic shell 11.

Lower chamber 13 contains a generally conventional electric motor 15 having a rotor 16 through which extends a drive shaft 17. Bearings 17*a* and 17*b* are provided on the upper end of drive shaft 17 and in combination, act both to radially center and to support the drive shaft 17 and rotor 16 within motor 15. The upper end of drive shaft 17 includes a crankpin 18 having its axis generally parallel to drive shaft 17 but offset therefrom. As drive shaft 17 is rotatably driven by electric motor 15, crankpin 18 pivots in a journal bearing 18*a*, causing a swing link 19 connected thereto, to rotate about its axis. Swing link 19 serves as a radially compliant drive element which engages drive stud 20 formed on the lower surface of orbiting plate 25. As swing link 19 rotates, drive stud 20 describes a circular orbit about the axis of swing link 19, moving within journal bearing 20*a*. Swing link 19 thus translates the rotational motion of drive shaft 17 into the orbiting motion of orbiting plate 25.

FIGS. 1 and 3 illustrate how orbiting wrap element 26, having a generally spiral shape about an axis parallel to the axis of drive shaft 17 is affixed to the upper surface of orbiting plate 25. It can be seen that orbiting wrap element 26 contacts a fixed wrap element 27, having a similar spiral shape, at various points along their facing flank surfaces. The fixed wrap element 27 depends from a fixed plate 28 which is generally parallel to and facing orbiting plate 25.

Orbiting wrap element 26 and fixed wrap element 27 are maintained in fixed angular relationship to each other by use of an Oldham coupling comprising circular ring 29, to which four sliding blocks 30 are pivotally mounted by means of nut and bolt fasteners 31. Blocks 30 slideably engage slots 30*a* formed diametrically opposite each other in supporting frame 14, and at 90° thereto, in orbiting plate 25, and thus restrain the orbiting plate 25 from angular displacement while permitting it to undergo circular translation with a variable circular orbiting radius. Fixed plate 28 is in turn held in place by a plurality of spaced-apart flange supports 32*a*, 32*b*, 32*c*, and 32*d*, each of which are connected to the supporting frame 14 by bolts 33. Orbiting scroll plate 25 is supported in the axial direction by a circular thrust bearing 34.

Lubrication for the various bearing surfaces in the machine, such as thrust bearing 34, is provided by an oil pump 35 which extends from the lower end of shaft 17 into a reservoir of oil 36 at the bottom of the compressor. Oil pump 35 is of the centrifugal type and is operative during rotation of shaft 17 to force oil to flow up through a hollow bore (not shown) in the shaft 17 to lubricate the bearing surfaces in the upper part of compressor 10.

As shown in FIG. 3, a perimeter wrap element 40 extends from point "A" counterclockwise around to point "B" in enclosing relationship to a first inlet 41 and second inlet 42 formed in fixed plate 28. Perimeter wrap element 40 is a lobular shaped extension of the fixed wrap element 27, between points A and B, and provides the means for sealingly enclosing inlets 41 and 42 so that fluid flow through these inlets into pockets defined by wrap elements 26 and 27, may be controlled. In a conventional scroll compressor of the prior art, fluid is free to enter the involute wrap elements from inside the compressor shell by flowing past the radially outer end of the fixed wrap element (represented by point A) and the end 26*a* of orbiting wrap element 26. In the subject invention, these portions of the wrap elements are isolated from the fluid in chamber 12 by perimeter wrap 40, and from each other by a compliant seal 43. In the embodiment of the invention shown in FIG. 3 and in detail in FIG. 4, the compliant seal comprises a spring steel strip having a width equal to the separation between facing surfaces of the orbiting plate 25 and the fixed plate 28, and extending from the radially inner surface of perimeter wrap element 40 to the radially outer flank surface of orbiting wrap element 26. Compliant seal 43 is biased to remain in contact with the orbiting wrap element 26 at all times during its orbital motion and is held in place by suitable fastening means, such as a metal screw 44. Compliant seal 43 is operative to interrupt fluid flow between first inlet 41 and second inlet 42, around orbiting wrap element 26.

As shown in FIGS. 1 and 3, an outlet 45 for compressed fluid is disposed near the center of the fixed plate 28, above which, a conduit 46 extends radially outward and down through support frame 14, in fluid communication with lower chamber 13. Also connected to the fixed plate 28 are a first valve 47 and a second valve 48. Valves 47 and 48 control the flow of suction fluid from chamber 12 through first and second inlets 41 and 42, respectively, and may comprise electric solenoid valves if it is desired to completely open or close inlets 41 and 42, or proportional valves if instead, it is desired to modulate the flow of suction fluid over an intermediate range of control. In either case, valves 47 and 48 are controlled electrically via leads 47*a* and 48*a* connected to terminals 53 which extend through hermetic shell 11. Terminals 53 are enclosed in a box 54 mounted on the outside of hermetic shell 11.

In the first embodiment shown in FIGS. 1 through 4, fluid enters a suction port 49 and flows into the upper chamber 12 at a relatively low suction pressure. When compressor 10 is to operate at full capacity, both first and second valves 47 and 48 are fully opened, allowing fluid to flow through inlets 41 and 42 into pockets formed between the orbiting and fixed wrap elements 26 and 27. The moving line contacts between these wrap elements define pockets 50*a*, 50*b*, and 50*c* as shown in FIG. 3. As pockets 50*a* and 50*b* move toward the center of the scroll, the volume of the fluid contained therein is substantially decreased and its pressure proportionally increased.

Immediately downstream of and above outlet 45 is disposed a discharge check valve (shown in detail in FIG. 6) comprising a flat circular valve plate element 51 biased by helical spring 52 to close outlet 45. When the pressure of the fluid in pocket 50*c* at outlet 45 is greater than the combined force of spring 52 and that resulting from the fluid pressure in conduit 46, the fluid pressure at outlet 45 unseats the discharge check valve plate element 51, thereby allowing fluid to flow out through conduit 46 into the lower chamber 13. This discharge fluid subsequently enters passage 55 in support frame 14, flows past rotor 16, and exits compressor 10 through a discharge port 56.

To modulate the capacity of compressor 10 to 50% of its rated output, valve 48 is closed, thereby preventing fluid from entering second inlet 42. Suction fluid continues to enter first inlet 41 with minimal restriction, but is prevented from flowing around the outer flank surface of orbiting wrap element 26 to second inlet 42 by compliant seal 43. Fluid entering first inlet 41 is compressed by the motion of orbital wrap element 26 relative to the fixed wrap element 27. Since valve 48 is closed, the pressure within second inlet 42 drops to near vacuum level as compressor 10 continues to operate. Under these conditions, intermediate fluid pocket 50*a* contains compressed fluid, and intermediate fluid pocket 50*b* contains fluid at near vacuum pressure. As these pockets of fluid, one at high pressure and the other at near vacuum pressure, continue to combine at the outlet 45 in a common pocket 50*c*, the resultant pressure initially drops, but then increases with the continuing motion of the orbiting scroll element 26 until it reaches equilibrium with the pressure in conduit 46. Discharge check valve 51 prevents back flow of fluid into outlet 45 from the system to which discharge port 56 is attached. Fluid only flows past the discharge check valve plate 51 and out through conduit 45 if the system pressure within conduit 46 is less than that at outlet 45. Since outlet 45 receives only 50% of the previously available compressed fluid in each cycle, the output of compressor 10 is reduced by about 50%.

To completely unload compressor 10, both first and second valves 47 and 48 are closed, interrupting suction fluid flow through both inlets 41 and 42. The pressure at outlet 45 subsequently reaches an equilibrium pressure, with no fluid flow past discharge check valve plate 51.

If proportional valves 47 and 48 are used instead of on/off type solenoid valves, the capacity of compressor 10 may be modulated to any value between about 0 and 100% of its rated output capacity. If both first and second valves 47 and 48 are partially closed, fluid flow through both first and second inlets 41 and 42 is thereby restricted and the mass flow through the compressor is reduced. Alternatively, second valve 48 may be partially closed, and first valve 47 left completely open to control capacity in the range of 50 to 100% of rated output. It should be apparent that first valve 47 cannot be closed to restrict fluid flow more than second valve 48 without causing fluid to bypass compliant seal 43, since compliant seal 43 acts to seal against the outer flank surface of orbiting wrap element 26 only if the fluid pressure at first inlet 41 is equal to or greater than the pressure at second inlet 42. Thus, when reducing the capacity of compressor 10, it is necessary to close second valve 48 more than first valve 47 or to close both valves by equal amounts.

In another embodiment of the subject invention shown in FIGS. 5 and 6, the compliant seal element between first inlet 41 and second inlet 42 comprises a complaint vane seal 57, generally radially aligned so that one end 57*a* is biased against the outer surface of orbiting scroll element 26 by a helical spring 58. These elements 57 and 58 are sealingly mounted in a box 58*a* external to a perimeter wrap element 59. Perimeter wrap elements 59 and 40 are similar, except that the former includes a slot through which the compliant vane seal 57 is free to move radially inward and outward in sealing relationship with both the perimeter wrap 59 and orbiting scroll element 26. Compliant vane seal 57 extends between orbiting plate 25 and fixed plate 28 and provides the equivalent sealing function of compliant seal 43, serving to interrupt the flow of fluid around the periphery of orbiting wrap element 26, between first inlet 41 and second inlet 42. An advantage provided by compliant vane seal 57 over compliant seal 43 is that it serves to interrupt fluid flow between inlets 41 and 42 regardless of which is at higher pressure; thus, either valve 47 or 48 may be completely or partially closed to control the capacity of compressor 10.

Turning now to FIG. 7, an alternative scroll compressor incorporating the subject invention is shown, generally denoted by reference numeral 65. Elements of scroll compressor 65 which are similar to those of compressor 10 are designated with the same reference numerals and their functions will not be explained again. However, functional aspects of these elements which are different are noted, as appropriate. Scroll compressor 65 includes an hermetic shell 66 housing a radially compliant drive mechanism and electric motor 15, as in compressor 10. The supporting frame 67 does not define a sealing partition between the upper and lower portion of the volume enclosed by hermetic shell 66, but does provide a support for motor 15 and other elements such as flange supports 32*a* through *d* which extend from fixed plate 68 at spaced apart intervals.

Fixed plate 68 also includes first valve 47 and second valve 48 which are disposed in substantially the same relationship to fixed wrap element 27 and orbiting wrap element 26 as in scroll compressor 10. In compressor 65, the free volume enclosed by hermetic shell 66 is substantially at discharge pressure, and it is necessary to convey suction fluid to first and second valves 47 and 48 by means of a conduit 69. Conduit 69 connects the upstream side of valves 47 and 48 in common fluid communication with a suction port 69*a*, thereby providing fluid communication means for suction fluid to reach first and second inlets 41 and 42.

Fluid compressed by the moving line contact between orbiting wrap element 26 and fixed wrap element 27 exits through outlet 45 in fixed plate 68 whenever the pressure within outlet 45 exceeds that within hermetic shell 66. Discharge check valve plate element 51 prevents backflow of fluid from inside hermetic shell 66 into outlet 45, thereby increasing the efficiency of the compressor when it is operated in a partially loaded state. Compressed fluid ultimately passes through passage 55, around rotor 16, and out discharge port 56, cooling motor 15 in the process.

The capacity of compressor 65 is reduced by opening or closing valves 47 and/or 48 as described hereinabove for compressor 10. Either the flat spring steel compliant seal 43 or the compliant vane seal 57 may be used in compressor 65 to prevent the flow of suction fluid between first inlet 41 and second inlet 42. The unloading of compressor 65 is thus essentially carried out in the same fashion as for compressor 10, however compressor 65 has the advantage of not requiring a fluid seal between supporting frame 67 and the interior portion of the hermetic shell 66.

Yet a still further version of a scroll compressor incorporating the subject invention is shown in FIG. 8, wherein the scroll compressor is generally denoted by reference numeral 70. In this embodiment as before, elements having similar function and form are denoted by the same reference numerals. Scroll compressor 70 differs from the previous compressors 10 and 65 in three important ways. First, its hermetic shell 66 operates at suction pressure and includes a suction port 71 disposed in its lower portion, and a discharge port 72 mounted on its top surface. Secondly, motor 15 is cooled by suction fluid entering port 71 and passing around rotor 16; suction fluid thereafter enters the upper portion of hermetic shell 66 through passage 55.

The third and most significant difference concerns first valve 74 and second valve 75. These valves comprise respectively, pistons **74*a* and 75*a*, and helical springs 74*b* and 75*b*. When valves 74 and 75 are open, these pistons 74*a* and 75*a* are pushed vertically upward by the action of the helical springs, thereby allowing fluid to flow through first and second inlets 76 and 77, respectively. The upper portion of these valves are connected to first and second electric solenoid valves 74*c* and 75*c* by means of conduits 78*a* and 78*b*, respectively, and the solenoid valves 74*c*, and 75*c* are in common fluid communication with a T-shaped conduit 73 through which discharge gas is conveyed from the compressor 70. By selectively opening solenoid valves 74*c* and 75*c* (electrical leads and terminals not shown), fluid at discharge pressure may be applied to either piston 74*a* or 75*a*, forcing that piston to close either the first and/or second fluid inlets 76, 77, against the spring force provided by helical springs 74*b* and 75*b***. A more detailed explanation of the operation of a similar type valve used for unloading a scroll compressor is disclosed in prior U.S. application Ser. No. 202,967, filed in 1980, now U.S. Pat. No. 4,383,805 assigned to the same assignee as the present application.

After either solenoid valve **74*c* or 75*c* is selectively closed to prevent discharge fluid from being applied to pistons 74*a* or 75*a*, discharge fluid within first and second valves 74 and 75 leaks past the pistons, allowing them to move to the open position under the influence of springs 74*b* and 75*b*. It should be apparent, that first and second valves 74 and 75 might be replaced in compressor 70 by either simple electric solenoid valves or by proportionately controlled valves similar to first and second valves 47 and 48**.

In other respects, compressor 70 operates substantially the same as scroll compressors 10 and 65. Again, either spring steel strip compliant seal 43 or compliant vane seal 57 may be used to interrupt fluid flow between first inlet 75 and second inlet 77. Discharge pressure actuated valves 74 and 75 are selectively controlled to completely open or close first or second inlets 76 and 77, and may not be modulated to an intermediate position. For this reason, the discharge fluid actuator valves 74 and 75 shown in FIG. 8 can be used to reduce the capacity of compressor 70 to either approximatey 50% or 0% of its rated output, by actuating one or both, respectively. Use of proportional control valves 47 and 48 would provide selective control over the entire range of 0 to 100% of rated output.

If capacity control of only one of the inlets on compressors 10, 65, and 70 is sufficient for a particular application, it is necessary to only provide one of first and second valves 47, 48, or 74, 75; however, if the spring steel compliant seal is used, that valve 48 or 75 must be applied to the second inlet 42 or 77, respectively, rather than the first inlet 41 or 76. If the compliant vane seal 57 is used, a single valve may be used on either of the inlets; in any case, the other inlet must be connected to suction fluid. A single valve, of course, can only modulate the capacity of compressors 10, 65, or 70 in the range of about 50% to 100% of their rated full output.

Although the invention is described with respect to several preferred embodiments, further modifications thereto will become apparent to those skilled in the art upon a consideration thereof. The scope of the invention is therefore to be determined by reference to the claims which follow.

We claim:

1. In a fluid compressor of the positive fluid displacement scroll type, apparatus for modulating the compressor's capacity comprising a. two generally parallel plates, the facing surface of each having an involute wrap element attached thereon in fixed angular, intermeshed relationship with the wrap element of the other, said wrap elements each defining a radially inner and a radially outer flank surface of similar spiral shape about an axis, contacting flank surfaces of the intermeshed wrap elements and plates defining pockets of fluid as said plates are caused to move relative to each other, one of the wrap elements being extended to enclose the radially outer end of the other wrap element in circumvallate, sealing relationship;

b. a first and a second fluid inlet, each in fluid communication with the volume enclosed by said one wrap element and disposed adjacent the periphery thereof;

c. a compliant sealing member operative to interrupt fluid communication between said first and second fluid inlets along the inner flank surface of the extended portion of said one wrap element; and d. a first valve operatively connected to control fluid flow into one of said first and second fluid inlets to modulate the capacity of the compressor.

2. The apparatus of claim 1 wherein complete closure of the first valve reduces the capacity of the compressor by approximatey 50%, and partial closure of the first valve is operative to modulate the capacity to within the range from 50 to 100%.

3. The apparatus of claim 1 further comprising a second valve operatively connected to control fluid flow through the other of said first and second fluid inlets.

4. The apparatus of claim 1 or 3 wherein the compliant sealing member comprises a vane which slides against the outer flank surface of said other wrap element in sealing relationship, and is biased in the radial direction so that it remains in contact with that flank surface when the radial distance between the wrap elements changes.

5. The apparatus of claim 1 or 3 wherein the compliant sealing member comprises a flexible strip extending generally tangentially from the inner flank surface of the extended portion of the one wrap element to the outer flank surface of the other wrap element.

6. The apparatus of claim 5 wherein the flexible strip is formed of spring steel.

7. The apparatus of claim 1 or 3 further comprising a discharge port through which fluid compressed between the intermeshed wrap elements is discharged, and a check valve operative to allow compressed fluid to flow out from the discharge port and to prevent fluid from flowing into the fluid pockets between the wrap elements through the discharge port.

8. The apparatus of claim 3 wherein complete closure of one of the first or second valves reduces the capacity of the compressor by 50%, complete closure of both the first and second valves unloads the compressor to 0% capacity, and partial closure of one or both first and second valves modulates the capacity to within the range from 0 to 100%.

9. A positive displacement scroll type fluid compressor comprising a. two generally parallel plates, the facing surface of each having an involute wrap element attached thereon in fixed angular, intermeshed relationship with the wrap element of the other, said wrap elements of each defining a radially inner and a radially outer flank surface of similar spiral shape about an axis, contacting flank surfaces of the intermeshed wrap elements and plates defining pockets of fluid;

b. a drive shaft rotatably driven about a longitudinal axis by a prime mover, and operatively connected to one of the two parallel plates in driving relationship, the other plate being fixed so that said one plate is caused to orbit relative to the fixed plate when the drive shaft rotates;

c. a perimeter wrap attached to the fixed plate on the same surface as its involute wrap element, extending from that involute wrap element in a lobular shape which encloses the wrap element on the orbiting plate in circumvallate sealing relationship;

d. a first and a second fluid inlet, disposed generally diametrically opposite each other in the fixed plate adjacent its periphery, and in fluid communication with one or more of the fluid pockets as they are formed;

e. a compliant sealing member disposed adjacent the perimeter wrap, extending between it and the outer flank surface of the orbiting plate involute wrap element and between the parallel plates in sealing relationship, said member being operative to prevent fluid flow between the first and second fluid inlets; and f. valve means for controlling fluid flow to at least one of the first and second fluid inlets and thereby operative to modulate the capacity of the compressor.

10. The scroll compressor of claim 9 wherein the valve means are operative to modulate compressor capacity within the range from about 50 to 100% of its rated output.

11. The scroll compressor of claim 9 wherein said valve means control fluid flow to both the first and second fluid inlets.

12. The scroll compressor of claim 11 wherein the valve means are operative to modulate compressor capacity within the range from about 0 to 100% of its rated output.

13. The scroll compressor of claim 9 or 11 wherein the compliant sealing member comprises a vane which slides against the outer flank surface of said other wrap element in sealing relationship, and which is biased in the radial direction so that it remains in contact with that flank surface during the relative orbital motion of the wrap element.

14. The scroll compressor of claim 9 or 11 wherein the compliant sealing member comprises a flexible strip extending generally tangentially from the radially inner surface of the perimeter wrap to the outer flank surface of the wrap element on the orbiting plate.

15. The scroll compressor of claim 9 or 11, further comprising a hermetic shell sealingly enclosing a spacial volume which includes at least the parallel plates of the scroll compressor, said hermetic shell including a suction port for admitting fluid to the compressor at suction pressure, and a discharge port through which compressed fluid is dispelled at discharge pressure.

16. The scroll compressor of claim 15 wherein the hermetic shell is at suction pressure, with the suction port in fluid communication with the free volume enclosed by the hermetic shell and thereby in fluid communication with said valve means.

17. The scroll compressor of claim 15 wherein the hermetic shell is at discharge pressure, the discharge port is in fluid communication with the free volume enclosed by the hermetic shell, and the suction port is in fluid communication with the valve means.

18. The scroll compressor of claim 15 further comprising a check valve, operative to allow fluid to be discharged from the wrap elements out through the discharge port and to prevent fluid from backflowing into the fluid pockets between the wrap elements from the discharge port.

19. The scroll compressor of claim 9 or 11, further comprising a hermetic shell sealingly enclosing the parallel plates and divided into a first and a second chamber, said hermetic shell including a suction port for admitting fluid to the compressor at suction pressure, and a discharge port through which compressed fluid is dispelled at discharge pressure.

20. The scroll compressor of claim 19 wherein one of the first and second chambers is at discharge pressure and the other is at suction pressure.

* * * * *